US005216791A

United States Patent [19]

Gillespie et al.

[11] Patent Number: 5,216,791

[45] Date of Patent: Jun. 8, 1993

[54] SYNTHETIC YARN BULKING JET APPARATUS

[75] Inventors: Donald W. Gillespie; Jon O. Stanley, both of Seaford, Del.

[73] Assignee: E. I. Du Pont de Nemours and Company, Wilmington, Del.

[21] Appl. No.: 876,725

[22] Filed: Apr. 23, 1992

[51] Int. Cl.[5] ..... D02J 1/00

[52] U.S. Cl. ..... 28/274; 28/271

[58] Field of Search ..... 28/271, 272, 273, 274; 57/22, 280, 284, 333, 350

[56] References Cited

U.S. PATENT DOCUMENTS

| | | | |
|---|---|---|---|
| 2,852,906 | 9/1958 | Breen | 57/34 |
| 2,958,112 | 11/1960 | Hall . | |
| 3,186,155 | 6/1965 | Breen et al. | 57/140 |
| 3,261,071 | 7/1966 | Clendening, Jr. et al. . | |
| 3,409,956 | 11/1968 | Longbottom et al. . | |
| 3,430,427 | 3/1969 | Gabbitus et al. | 28/271 X |
| 3,525,134 | 8/1970 | Coon . | |
| 3,581,486 | 6/1971 | Dibble | 28/272 X |
| 3,638,291 | 2/1972 | Yngve . | |
| 3,842,468 | 10/1974 | Harrison . | |
| 3,845,528 | 11/1974 | Vermeer et al. | 28/271 |
| 4,097,975 | 7/1978 | Moeller | 28/271 X |
| 4,251,904 | 2/1981 | Sano et al. | 28/271 X |
| 4,297,772 | 11/1981 | Seney | 28/257 |
| 4,644,622 | 2/1987 | Bauer et al. | 28/271 |
| 5,003,677 | 4/1991 | Krenzer | 28/271 X |

FOREIGN PATENT DOCUMENTS

| | | | |
|---|---|---|---|
| 653755 | 12/1962 | Canada | 28/272 |
| 0065133 | 4/1985 | Japan | 28/271 |
| 2128644 | 5/1985 | United Kingdom | 28/272 |

*Primary Examiner*—Clifford D. Crowder
*Assistant Examiner*—John J. Calvert

[57] ABSTRACT

Apparatus is disclosed to prevent yarn from melting when stopped in a high temperature fluid texturing jet. A heat sink is attached to the jet body and thermally insulated from the conduit supplying the high temperature fluid to the jet.

1 Claim, 2 Drawing Sheets

SYNTHETIC YARN BULKING JET APPARATUS

BACKGROUND OF THE INVENTION

This invention relates to a jet for treating yarn from synthetic filaments with heated fluid to introduce random curvilinear crimp. In particular, it relates to a jet for utilizing fluid temperatures above the melt temperature of the synthetic filaments and preventing the filaments from melting on contact with the jet when the yarn is stopped in the jet.

U.S. Pat. No. 3,186,155 discloses that the most effective bulking and greatest productivity of synthetic fibers made from fusible polymer is obtained when the temperature of the heated fluid is above the melting point of the fiber. In this case, the patent teaches, that the yarn speeds should be great enough so that melting does not occur. In such jet bulking processes, the jet body is at a temperature which would cause the filaments to melt and stick to the jet surfaces if they were not moving rapidly. Any process interruption which causes the yarn to stop in the jet may cause the yarn to melt in the jet. The jet must then be removed and cleaned to remove the melted polymer. This procedure is time consuming and costly.

SUMMARY OF THE INVENTION

A jet is provided that treats yarn of synthetic filament with fluids heated above the melt temperature of the filaments wherein the filaments will not melt in the jet when they are stopped in the jet. The jet comprises a body with a passage through which yarn passes for treatment with heated fluid supplied to the passage through a conduit passing through the body. A heat sink is connected to the body and means are provided for thermally separating the conduit from the heat sink whereby the temperature of the body is maintained below the temperature of the heated fluid used to treat the yarn.

DETAILED DESCRIPTION OF THE PREFERRED EMBODIMENT

Figure 1:
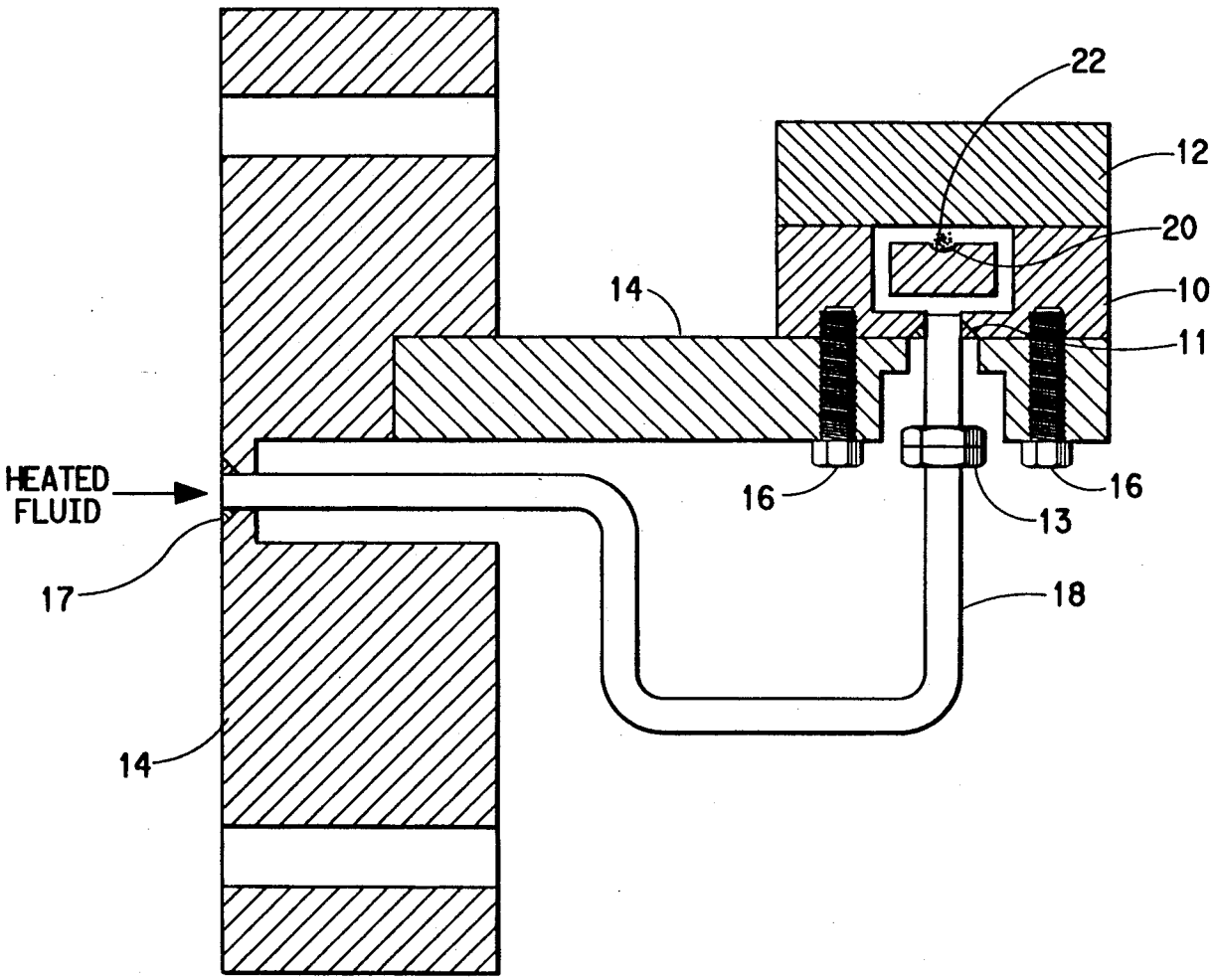
FIG. 1 is a side elevation view partially in section of the jet apparatus of this invention.

The embodiment chosen for purposes of illustration as shown in FIG. 1 includes a jet body 10 with its associated cap 12 attached to a heat-sink mount 14 by means of bolts 16. Conduit 18 is in communication with the yarn passage 20 in the jet body 10 through which yarn 22 passes for treatment. In particular, conduit 18 is attached to heat-sink mount by weld 17 and to jet body 10 by weld 11. Tubing fitting 13 allows the jet body to be separated from conduit 18. Heated fluid from a controlled heat source (not shown) enters the yarn passage 20 via conduit 18. Conduit 18 is thermally separated from the heat-sink 14 by keeping metal contact at welds 11 and 17 to a minimum and maintaining an air gap between the tubing and the heat-sink 14. In addition, the conduit may also be covered with insulation.

If gaskets are required for a fluid seal between jet body 10 and heat-sink mount 14, they are preferably of copper, aluminum or a carbon filled material or similar thermally conductive material.

Figure 2:
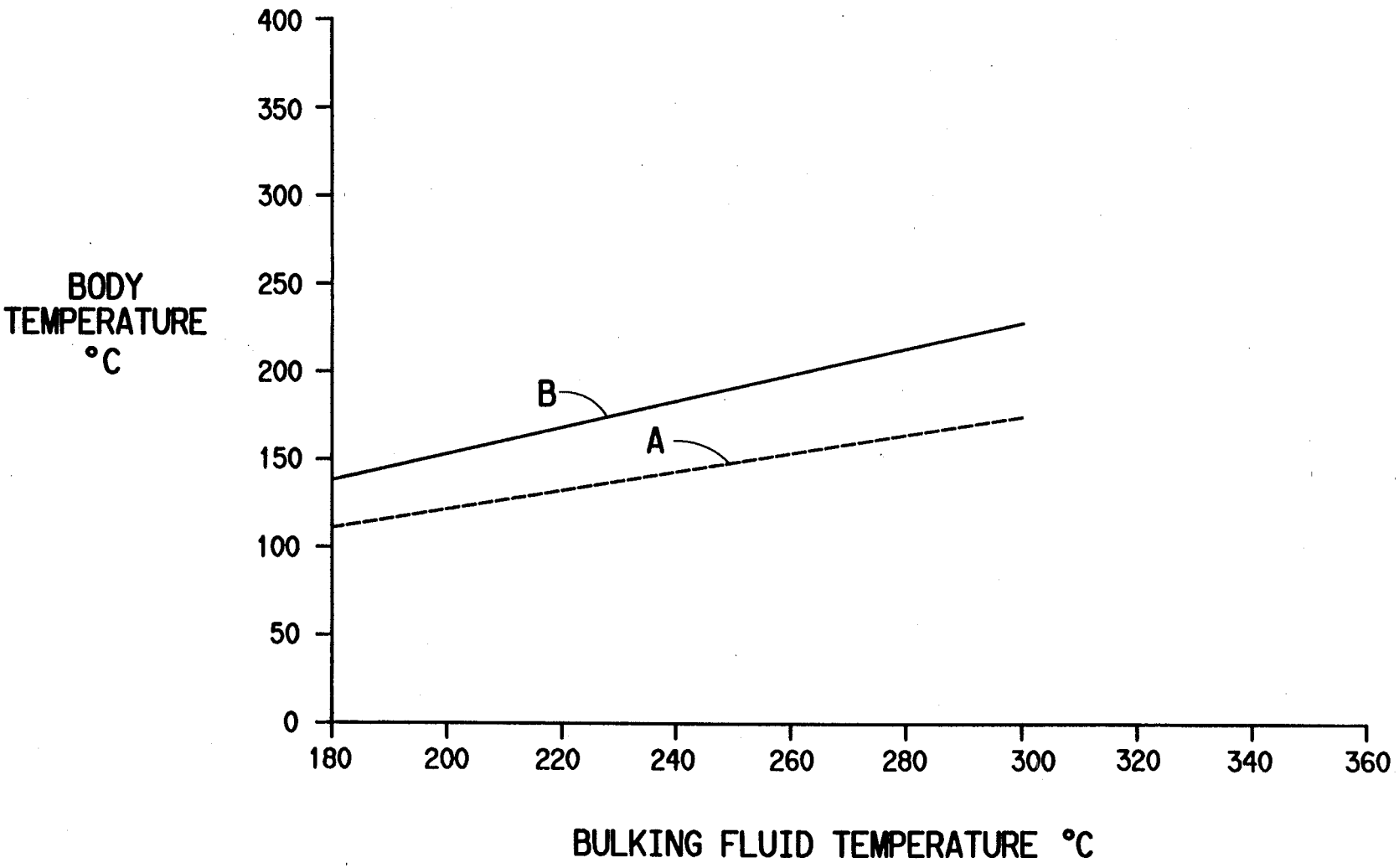
FIG. 2 is a chart showing a comparison of the jet body temperature of prior art jets with that of a jet of the instant invention at varying bulking fluid temperatures.

In a series of tests comparing a jet of the prior art wherein the passage for heated fluid was formed in the mounting block and a jet substantially as disclosed in FIG. 1, the heated jet bulking fluid was varied from about 180° C. to above 300° C. and in the course of bulking yarn passing through the jet, the jet body temperature of the jet of the instant invention remained well below that of the prior art jet as shown in FIG. 2, wherein line A represents the jet body temperature of a jet of the instant invention and line B represents the jet body temperature of a prior art jet at various bulking fluid temperatures.

We claim:

1. A jet for treating synthetic yarn with a fluid heated above the melt temperature of the yarn comprising: a body having a longitudinal passage through which yarn passes for treatment; a conduit passing through said body in communication with said longitudinal passage for directing said heated fluid against yarn passing through the longitudinal passage; means for supplying said heated fluid to said conduit; a heat sink connected to said body said heat sink having a recess to provide an air gap surrounding said conduit for thermally separating said conduit from said heat sink whereby the temperature of the body is maintained at a temperature lower than the temperature of said fluid.

* * * * *